United States Patent [19]

Reif

[11] Patent Number: 4,597,780

[45] Date of Patent: Jul. 1, 1986

[54] ELECTRO-INERTIAL PRECIPITATOR UNIT

[75] Inventor: Robert B. Reif, Grove City, Ohio

[73] Assignee: Santek, Inc., Greensboro, N.C.

[21] Appl. No.: 356,429

[22] Filed: Mar. 9, 1982

Related U.S. Application Data

[63] Continuation-in-part of Ser. No. 270,675, Jun. 4, 1981, abandoned, which is a continuation of Ser. No. 898,556, Apr. 21, 1978, abandoned.

[51] Int. Cl.[4] ..... B03C 3/53; B03C 3/78

[52] U.S. Cl. ..... 55/119; 55/127; 55/DIG. 38

[58] Field of Search ..... 55/119, 118, 122, 127, 55/238, 261, DIG. 38; 261/79 A, 112

[56] References Cited

U.S. PATENT DOCUMENTS

| | | | |
|---|---|---|---|
| 538,557 | 4/1895 | Theisen | 55/119 X |
| 1,953,405 | 4/1934 | Hedberg | 55/119 X |
| 2,259,030 | 10/1941 | Fisher | 55/238 X |
| 2,883,167 | 4/1959 | Krantz | 261/16 |
| 2,937,709 | 5/1960 | De Seversky | 55/119 |
| 3,009,687 | 11/1961 | Hendriks | 261/112 X |
| 3,138,647 | 6/1964 | Krantz | 261/112 |
| 3,238,702 | 3/1966 | De Seversky | 55/119 |
| 3,439,476 | 4/1969 | Knight | 55/127 X |
| 3,593,968 | 7/1971 | Geddes | 261/112 X |
| 3,770,385 | 11/1973 | Grey et al. | 55/118 X |
| 3,959,420 | 5/1976 | Geddes et al. | 261/112 |

*Primary Examiner*—Kathleen J. Prunner
*Attorney, Agent, or Firm*—Michael Ebert

[57] ABSTRACT

An electro-inertial precipitator unit for removing particulate contaminants from a gaseous stream passing through a collector tube having a discharge electrode coaxially disposed therein to establish an electrostatic field between the electrode and a downwardly-flowing water film on the inner surface of the tube. The gaseous stream is introduced tangentially into an upper inlet section of the tube to impart a swirling motion thereto, the water being supplied to an annular inlet slot just below the gas inlet section. Because of the centrifugal force generated by the cyclonic motion, the particles in the gaseous stream are urged to migrate toward the water film, this migration being further promoted by the electrostatic force acting on the particles which are charged with ions in the field. Air is blown over the surface of the upper lip of the water inlet slot to prevent wetting of this surface and the deposition of dust therein.

3 Claims, 3 Drawing Figures

Pressurized Air Source
40
Contaminated Gaseous Stream
25M
11
30
10A
30H
35
37
13
12
10C
10
34
Power Supply
21
33
10B
26A
32
22
31
23
26
Purified Gaseous Stream
28
27
29
Motor Control
Water Film
Water
20
19
18
Valve Control Circuit
16-I
24
17
16
15
16-O
Pump
Insulator
30
10A
Air
Air 39
13
38
Water
33
Water 12
10C
35A
10A
Air
37
35
36
13A
Water Inlet
13
10C
Water Film

ELECTRO-INERTIAL PRECIPITATOR UNIT

RELATED APPLICATIONS

This application is a continuation-in-part of application Ser. No. 270,675 filed June 4, 1981, and now abandoned, which in turn is a continuation of application Ser. No. 898,556 filed Apr. 21, 1978 and now abandoned, entitled "Wet-Wall Electroinertial Air Cleaner".

BACKGROUND OF INVENTION

This invention relates generally to a self-cleaning electro-inertial precipitator unit for removing particulate contaminants from a gaseous stream in which particles charged by ions are induced to migrate toward a downwardly-flowing liquid film formed on the inner surface of a collector tube, the migration resulting from the combined action of electrostatic and centrifugal forces whereby the stream may be purified in the course of its passage through the collector tube and more particularly to an arrangement adapted to maintain the wall of the collector tube free of dust in the region just above the liquid inlet slot.

Electrostatic precipitators separate contaminating particles or droplets of a semi-solid or solid nature from a gaseous stream. Such precipitators are especially helpful in removing finer particles (less than 40$\mu$) which cannot be extracted by conventional filters or other particle separators. In one known form of electrostatic precipitator of the dry type, the gases to be purified are conveyed through a collector tube where the particles are charged with ions in an electrostatic field, the charged particles migrating toward the inner surface of the collector tube having an opposite charge, thereby separating the particles from the gas flowing through the tube. With continued operation of a dry precipitator, the particles accumulate on the wall of the collector tube and it becomes necessary, therefore, at fairly frequent intervals, to shut down the precipitator in order to permit removal of the agglomerated particles.

With a wet-wall precipitator of the type disclosed, for example, in the deSeversky U.S. Pat. No. 3,716,966, a uniform film of downwardly flowing water is formed on the inner surface of the collector tube, the film serving to continuously flush away the contaminants, thereby obviating the need to interrupt the operation of the precipitator.

The use of centrifugal separators or cyclonic collectors for separating dust particles and other particulate contaminants of 25$\mu$ or larger from a gaseous stream is well known. In order, therefore, to effectively remove both large and small particles from a gaseous stream, one may first feed the gaseous stream through a cyclonic collector or inertial dust separator stage to extract the large particles from the stream and then feed the partially purified stream through an electrostatic precipitator stage to extract the fine particles therefrom as well as those larger particles not extracted in the preceding stage.

Thus U.S. Pat. No. 3,315,445 to deSeversky discloses a pollution control system in which gas scrubber and wet electrostatic precipitator stages are intercoupled in cascade relation so as to remove the full spectrum of contaminants from the stream. The practical drawback to the deSeversky arrangement, apart from the relatively high cost of providing both a gas scrubber and a wet electrostatic precipitator, is that these two units occupy a substantial amount of space. This creates installation difficulties in those installations where space is at a premium.

In the above-identified related patent applications of Reif, there is disclosed an electro-inertial wet-wall precipitator unit in which both fine and coarse particles are extracted from a contaminated gaseous stream by the combined action of centrifugal and electrostatic forces. The advantage of the apparatus disclosed in the prior applications is that it carries out in a single compact, integrated unit, functions heretofore requiring at least two units.

In the electro-inertial precipitator disclosed in the prior applications, the gaseous stream to be purified is fed at high velocity tangentially into an upper inlet section of a vertical collector tube to impart a cyclonic or swirling motion thereto, thereby causing the gas to flow in a helical path down the tube along a downwardly-flowing water film to impose an inertial force which imparts a swirling motion thereto serving to maintain the film against the tube surface.

Supported coaxially within the collector tube is a discharge electrode, a high voltage being impressed between the electrode and the water film to create an electrostatic field therebetween, the ions generated by the discharge electrode charging the particles carried by the gas. The centrifugal force created by the swirling motion of the gas induces the particles conveyed thereby to migrate toward the water film. This migration is further promoted by the action of the electrostatic field which causes the charged particles to travel toward the oppositely-charged water film. As a consequence, both coarse and fine particles are extracted from the gas and captured by the water film which washes the particles into the sump below the outlet section of the tube.

In operation, there is a tendency for water flowing through the inlet slot to wick upwardly along the surface of the upper lip of the slot, thereby wetting this surface. As a consequence, dust particles in this region which impinge on the wet surface are caused to adhere thereto to create a layer of wet dust acting as a ground electrode which accelerates further deposition and further wicking. In time, a cake of dust is developed at the upstream side of the water inlet in the precipitator tube. This cake may slightly overlap the inlet slot at various points, thereby somewhat impeding water flow and disturbing the uniformity of the water film. Moreover, these cakes occasionally break off and deposit on the wet wall of the collector tube at sites where they are difficult to wash away. Such occasions sometimes give rise to arcing.

In the copending application of Reif and McCrady Ser. No. 339,711 filed Jan. 15, 1982 , entitled "Inlet Section for Inertial-Electrostatic Precipitator Unit", there is disclosed an electroinertial precipitator in which an annular water inlet is disposed just below the gas inlet section into which is introduced the gaseous stream to be purified. To avoid wetting the surface of the upper lip of the water inlet slot and thereby causing dust particles to deposit thereon, the inlet section is provided with a hydrophobic surface. The entire disclosure of the Reif and McCrady application is incorporated herein by reference.

This hydrophobic surface is effective for its intended purpose when the water used in the unit is ordinary tap water. But it is much less effective when the water has wetting agents dissolved therein in order to ensure wetting of the entire inner surface of the collector tube. Also the effectiveness of a hydrophobic surface is diminished if the particles being collected are readily soluble in water, for the water used in the unit is recirculated therein.

SUMMARY OF INVENTION

In view of the foregoing, the main object of this invention is to provide in an electro-inertial wet-wall precipitator unit which extracts both coarse and fine particles from a gaseous stream by the combined action of centrifugal and electrostatic forces, means to flow air over the surface of the upper lip of the water inlet slot of the unit to prevent wetting of this surface and the deposition of dust thereon.

More particularly an object of this invention is to provide a precipitator unit of the above type which operates effectively even when the particles to be extracted from the gaseous stream are constituted by fine, low density dust, the precipitator being maintained free of deleterious dust formations in the region above the liquid inlet slot.

Also an object is to provide a compact precipitator unit of the above type which operates efficiently and reliably and has low energy requirements.

Briefly stated, these objects are attained in an electroinertial wet wall precipitator unit for removing particulate contaminants from a gaseous stream passing through a collector tube having a discharge electrode coaxially disposed therein to establish an electrostatic field between the electrode and a downwardly-flowing water film on the inner surface of the tube. The gaseous stream is introduced tangentially into an upper gas inlet section in the tube to impart a swirling motion thereto, the liquid being supplied to an annular inlet slot just below the gas inlet section, which inlet slot has an upper lip whose surface is subject to wetting as a result of a wicking action.

Because of the centrifugal force generated by the cyclonic motion, the particles in the gaseous stream are urged to migrate toward the liquid film, this migration being further promoted by the electrostatic force acting on the particles which are charged with ions in the field.

To avoid wetting the surface of the upper lip of the water inlet slot, air is introduced into the collector tube at a position above the inlet slot and is directed downwardly to flow at a relatively high velocity over the surface to prevent wetting thereof and the deposition of dust thereon.

OUTLINE OF DRAWINGS

For a better understanding of the invention as well as other objects and further features thereof, reference is made to the following detailed description to be read in conjunction with the accompanying drawings, wherein:

FIG. 1 schematically illustrates an electro-inertial precipitator unit which includes means in accordance with the invention to prevent the deposition of dust on the surface of the upper lip of the water inlet slot;

DESCRIPTION OF INVENTION

Figures 1, 2, 3:
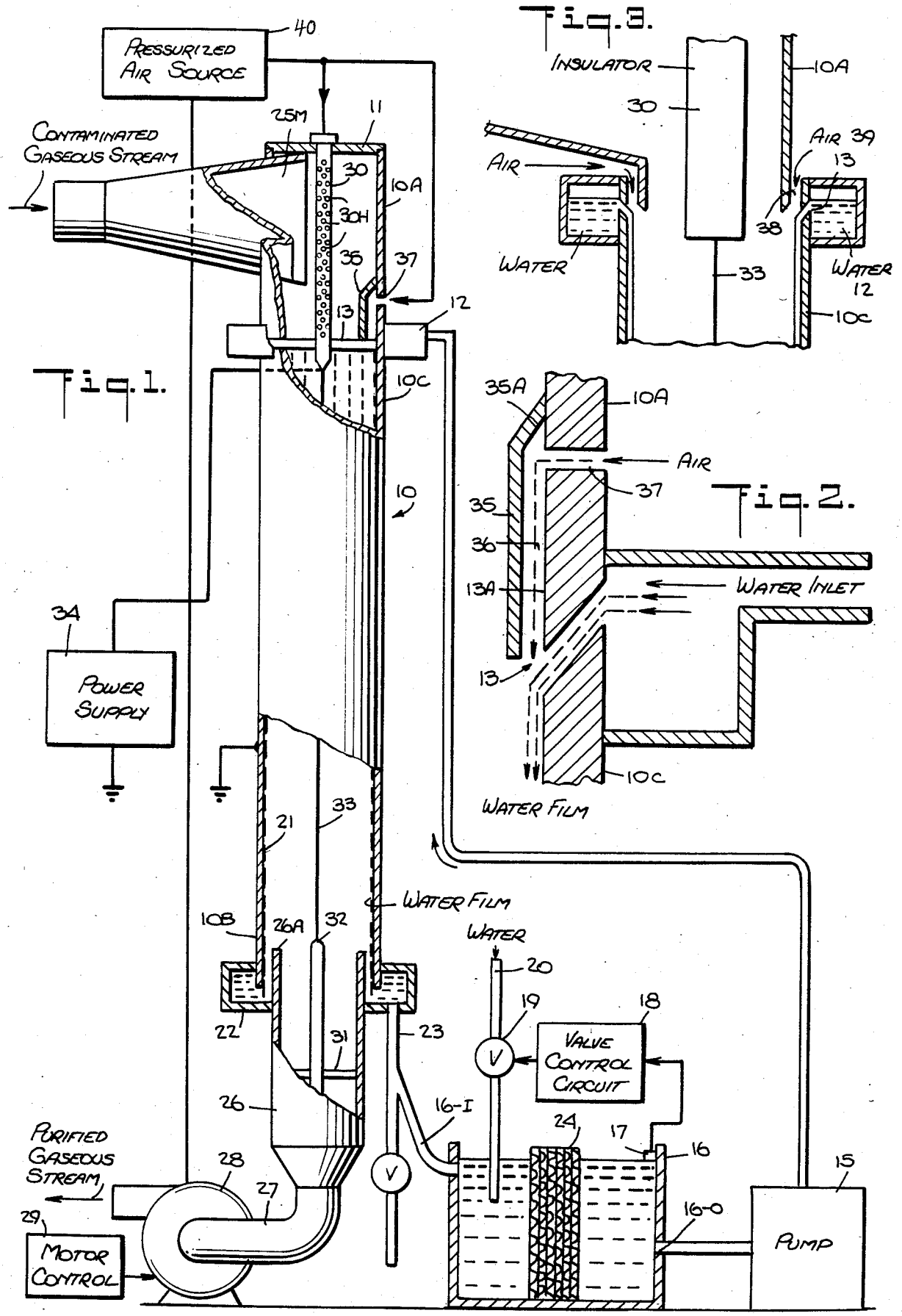
FIG. 2 illustrates one preferred arrangement for preventing dust deposition.
FIG. 3 illustrates another preferred arrangement.

Referring now to FIG. 1 which illustrates an electroinertial precipitator unit in accordance with the invention, it will be seen that the unit includes a vertically-mounted collector tube 10. The inlet section 10A at the upper end of the collector tube is closed by a cover 11, the outlet section 10B at the lower end being open. In practice, when the unit is used in a commercial installation, such as in grain elevators to extract grain dust from the contaminated atomsphere, tube 10 may have a 24-inch diameter and a 6-foot length.

Encircling tube 10 is a water distributor 12 which supplies water to an annular inlet slot 13 disposed at the junction of inlet section 10A and the main section 10C of the collector tube. Water is fed into distributor 12 through a pipe by a motorized pump 15 which draws the water from the output port 16-O of an open reservoir or tank 16 containing water.

As shown separately in FIG. 2, inlet slot 13 is downwardly inclined relative to the vertical wall of the collector tube, the configuration of the slot being such as to prevent water from shooting out into the collector tube so that the water emitted therefrom flows downwardly against the inner surface of the tube to create a water film thereon. Inlet slot 13 includes an upper lip whose surface 13A, as previously explained is subject to wetting as a result of a wicking action. The present invention, as will be later explained, provides means to keep this surface dry and to prevent the deposition of dust particles thereon so that no cake is formed which will impede flow from the inlet slot.

To maintain the water in tank 16 at a desired level, a level sensor 17 is provided which yields a signal that is applied to the control circuit 18 of a solenoid-operated valve 19. Valve 19 is interposed in a water input line 20 leading to a make-up water supply, the valve being opened only when the level of water in the tank falls below a predetermined level. Since the water in the unit is recirculated therein, the control system acts to replenish water lost through evaporation or drained from the tank.

Water emerging from annular inlet slot 13 flows down the inner surface of the main section 10C of the collector tube to create a uniform cylindrical water film 21 on the inner surface thereof, this film being discharged into a sump 22 surrounding outlet section 10B. Sump 22 returns the collected water through a gravity-flow pipe 23 into the input port 16-I of tank 16. In practice, sump 22 may be provided with baffles to prevent backflow of the water into the collector tube, for such backflow may cause arcing.

Interposed between the input and output regions of tank 16 is a replaceable filter 24 which intercepts and captures the dirt in the water drained from the collector tube so that the water returned to the tube is reasonably clean. Thus the water system associated with the precipitator unit is a closed loop in which the water is continuously recycled. In some cases, however, depending on the nature of the contaminants carried by the gaseous stream, the contaminant-laden water must be drained and not filtered and recycled.

The downwardly-flowing liquid film 21 flushes away contaminants collected by the film; and while water may be used for this purpose, in practice the flushing liquid may be a liquid having properties compatible with the gas to be purified. In some instances, it may be desirable to include a surfactant in the liquid to enhance its wetting characteristics to ensure wetting of the entire inner surface of the collector tube. Should use be made of a collector tube of ceramic or other electrical insulating material, rather than a metal tube which is electrically grounded, use is then made of a liquid such as ordinary tap water having an adequate degree of electrical conductivity, the liquid film in this case being grounded.

The gaseous stream to be purified is introduced into inlet section 10A of the collector tube through a spinner duct constituted by a horn-shaped transition section having a somewhat flattened mouth 25 M. The duct feeds the contaminated gas tangentially into the inlet section at one side thereof at high velocity, thereby causing the gas to undergo cyclonic or swirling motion. The upper end of duct mouth 25 M is flush with the tube cover 11 so that no free space exists between the mouth and the cover. In practice, a rotational gas inlet feed may be provided by vanes which impart a swirl component to the incoming gaseous stream.

This flush duct arrangement is necessary to eliminate stagnant gas swirls in this upper region of the precipitator tube. Such stagnant swirls would be produced were the mouth of the duct displaced below the cover 11, the dust deposits building up and resulting eventually in chunks which break off and fall into the precipitator tube where they give rise to arcing and also overload the flushing system.

Received within outlet section 10B of the collector tube is a tubular flue 26 whose inlet 26A is spaced from the inner surface of outlet section 10B to avoid disrupting the downward flow of liquid into sump 22. Flue 26 is coupled by an elbow 27 to a fan-type blower 28 whose purified gaseous output is exhausted into the atmosphere. Blower 28 is operated by a motor control circuit 29. When the contaminated stream is air at an elevated temperature, as is often the case in an industrial installation, the purified output stream may be used for room heating purposes rather than being wasted, for the degree of de-contamination is such as to render the air breathable.

Supported below cover 11 coaxially within the upper section 10A of the precipitator tube is an electrical insulating rod 30 whose tip is positioned somewhat below annular inlet slot 13. Supported coaxially within flue 26 by a spider 31 is a similar electrical insulating rod 32. Extending between the tips of the insulating rods and secured thereto is discharge electrode wire 33, the rods in combination with the wire forming the discharge electrode assembly of the unit. In practice, for a collector having a 4-inch diameter, the discharge wire may have an 8-mil diameter. But for collector tubes of larger diameter, larger diameter discharge electrode wires are appropriate, such as 30 mils or greater.

The upper insulating rod 30 is extended at least one or two inches below annular inlet slot 13. Consequently, discharge electrode wire 33 does not extend above slot 13 where charged particles would, because of the resultant electrostatic field, tend to deposit and remain on the inner surface of the inlet section 10A of the collector tube which is not flushed with water. Such deposition will foul the precipitator and is obviously undesirable. The actual distance of rod 30 below inlet slot 13 depends on the diameter of the precipitator tube: the larger the diameter, the greater the distance.

It is to be noted that since the upper insulating rod 30 is positioned within inlet section 10A which receives the contaminated gaseous stream, if the particles in the stream are somewhat conductive and adhere to the surface of the insulating rod, the resultant deposit may impair the electrical insulating properties of the rod and cause a short circuit. To minimize the exposure of rod 30 to such conductive particles, the mouth of the inlet section is arranged to blow the incoming gaseous stream to one side of the inlet section 10A and thereby sidestep the rod.

However, since inlet section 10A is suffused with the incoming gaseous stream, additional means must be provided to prevent fouling of insulating rod 30. To this end, insulating rod 30 is preferably of hollow construction and is provided with a circumferential array of holes 30H. Rod 30 is coupled to a pressurized air source 40 or to a suitable blower causing jets of air to be projected through the holes, these air jets preventing the deposit of dust particles on the rod surface. This expedient is particularly useful when the contaminated gaseous stream is derived from welding fumes carrying conductive particles. In practice, the pressurized air may be derived from the purified output of blower 28, thereby creating a closed rod purging system.

A direct-current high voltage of a magnitude such as 20 to 100 KV and higher is impressed between electrode wire 33 and grounded collector tube 10 by means of a suitable power supply 34. This voltage establishes an electrostatic field in the gas flow region in the precipitator tube between the discharge electrode and the liquid film 21 on the inner surface of the collector tube, the field acting to produce ions at the discharge electrode which charge particulate contaminants passing through the tube. In practice, particles in the gaseous stream, before being admitted into the tube, may be charged by a preionization stage.

Because the contaminated gaseous stream is fed tangentially into inlet section 10A and flows at high velocity by reason of the strong suction force developed by blower 28 coupled to outlet section 10B, the incoming stream is caused to spin cyclonically or swirl. This swirling motion causes the gas to spiral downwardly in a helical path and to impart a similar spiral motion to the liquid film flowing down the inner surface of the precipitator tube. And because the gas helix imposes an inertial force, this force acts to maintain the film against the collector tube.

Because of centrifugal force created by the swirling motion of the gas within the precipitator tube, the momentum imparted to the particles in the gas stream urges the particles to migrate laterally toward the liquid film and to be collected and flushed away thereby. Such inertial separation is generally more effective with relatively coarse and heavy particles than with fines.

The electrostatic field created by discharge electrode wire 33 extends between this wire and the corresponding surface of the water film surrounding the wire. This field acts to charge with ions the particles in the gaseous stream which passes through the field in a direction normal to the electric field lines. Because of the electrostatic force, the charged particles are urged to migrate toward the grounded liquid film, this force being effective with fine particles as well as coarse particles. Hence the combined action of inertial and electrostatic forces causes the full spectrum of particle sizes to be extracted from the gaseous stream. Thus the contaminated gaseous stream drawn into inlet section 10A of the precipitator tube emerges from outlet section 10B with virtually all contaminants removed therefrom.

When the particles in the gaseous stream are fine grain dust, the dust tends to deposit on the surface 13A of the upper lip of the annular inlet slot 13 as a result of a wicking action. In time, this dust deposit builds up to form a cake which slightly overlaps the annular liquid inlet slot in some areas thereof, thereby impeding full flow of liquid from the slot and disturbing the uniformity of the liquid film.

This interference produces an uneven flushing action. In operation, therefore, chunks of the resultant dust cake occasionally break off and are deposited on the wet wall. This fouls the liquid film on the wall, and in some instances results in excessive arcing.

In order to prevent wicking of water onto the otherwise dry surface 13A of the upper lip of the water inlet slot 13 and to keep the region adjacent this surface free of dust, there is welded or otherwise secured to the inner surface of the inlet section 10A of the collector tube, as shown in FIG. 2 a cylindrical apron 35 which is uniformly spaced by the wall of the inlet section to define an annular air passage 36, apron 35 being joined to inlet section 10A by a flared upper section 35A. An annular air inlet slot 37 is formed in the inlet section above the water inlet slot 13, the air inlet slot communicating with passage 36.

Blown into air inlet slot 37 which in practice may take the form of a circular ring of holes, is pressurized air derived from air source 40 or any other source of clean air. The resultant uniform current of air flowing at high velocity down passage 36 toward the water inlet slot serves to scavenge the surface 13A of the upper lip and prevent wetting thereof, this flow also serving to prevent the admission of dust into the passage. In this way the surface of the upper lip is kept clean and dry.

In FIG. 2, the apron 35 is anchored on inlet section 10A at a position above air inlet slot 37. In practice, the apron can be anchored at the upper lip of the air inlet slot and curved at this junction so that the incoming air need not make an abrupt right angle turn at this point.

In the arrangement shown in FIG. 2, apron 35 effectively acts to reduce the diameter of the inlet section 10A and the sloped upper portion 35A thereof which is welded to the inlet section 10A acts as a discontinuity in the flow path of the incoming contaminator gas which may create some undesirable turbulence in the gas flow.

To avoid the discontinuity in the arrangement shown schematically in FIG. 3, inlet section 10A is of reduced diameter relative to main section 10C of the collector tube and is telescoped slightly into the main section to a point in line with the water inlet slot 13 to create an air passage 38 therebetween. Air is blown into the inlet 39 to this passage to scavenge the surface of the upper lip of water inlet slot 13. In this way there is no impediment in the path of the incoming gas to be purified, the operation otherwise being essentially the same as in FIG. 2.

Thus the invention provides means in conjunction with the water inlet slot to maintain the surface of the upper lip of the slot free of water and dust.

While there have been shown and described preferred embodiments of an improved electro-inertial precipitator unit, in accordance with the invention, it will be appreciated that many changes and modifications may be made therein without, however, departing from the essential spirit thereof.

Thus while in the arrangement shown in FIG. 1, a pressurized source 40 supplies air to air inlet slot 37, it is not essential to the invention; for if slot 37 is directly exposed to the atmosphere, the pressure difference between the interior of the collector tube resulting from the blower action and the atmosphere will cause atmospheric air to be sucked into the slot.

I claim:

1. An electro-inertial precipitator unit for extracting dust and other particles from a contaminated gaseous stream, the unit comprising:

A. a vertically-mounted collector tube whose upper end is closed by a cover, said tube having an upper inlet section, a main section and open-ended outlet section;

B. a discharge electrode assembly including a wire extending through said main section having a high voltage applied thereon relative to said collector tube to establish between said wire and said tube an electrostatic field therein which causes ions to be generated at said wire;

C. means including an annular water inlet slot formed at the junction of the inlet and main sections of the tube to feed water therein to form a water film on the inner surface of the tube which flows downwardly into and is discharged from the open end of the outlet section, said water inlet slot having an upper lip whose surface is subject to wetting by a wicking action and the deposition of dust thereon;

D. scavenging means to blow air over the surface of the upper lip of the water inlet slot to prevent wetting of this surface and the deposition of dust thereon; said scavenging means being constituted by a cylindrical apron disposed within said collector tube and coaxially arranged with respect to said upper lip to define an air passage therewith whose lower end is adjacent said water inlet slot, and an annular air inlet slot formed in said collector tube above said water inlet slot and communicating with said air passage to introduce air into said air passage to scavenge the surface of the upper lip, the air discharged from the lower end of the passage being projected therefrom in a path substantially parallel to the water film flowing downwardly below the water inlet slot;

E. means to introduce said contaminated gas stream tangentially into said inlet section; and F. means coupled to said outlet section to produce a suction force drawing said steam from the inlet section at high velocity and, in combination with said means to introduce said gas tangentially, imparting a swirling motion thereto to cause said gaseous stream to flow in a helical path down the tube against the liquid film and to induce a swirling pattern therein, the centrifugal force created by the swirling motion urging particles carried by the stream to migrate and to be collected by the film and to be flushed out of the tube, which migration is further promoted by the electrostatic force acting on the particles which are charged by the ions in the field.

2. A unit as set forth in claim 1, wherein said air is derived from a pressurized source.

3. A unit as set forth in claim 1, wherein the water fed into the water inlet slot includes a wetting agent.

* * * * *